US008955240B1

(12) United States Patent
Loftus et al.

(10) Patent No.: US 8,955,240 B1
(45) Date of Patent: Feb. 17, 2015

(54) GREETING CARD WITH PULL ACTIVATED EFFECTS

(71) Applicant: American Greetings Corporation, Cleveland, OH (US)

(72) Inventors: Jim Loftus, Painesville, OH (US); Cheryl Cochran, Cleveland Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/308,033

(22) Filed: Jun. 18, 2014

Related U.S. Application Data

(60) Provisional application No. 61/873,956, filed on Sep. 5, 2013.

(51) Int. Cl.
*G09F 1/00* (2006.01)
*B42D 15/02* (2006.01)

(52) U.S. Cl.
CPC ..... *B42D 15/022* (2013.01)
USPC ..... 40/124.03

(58) Field of Classification Search
CPC ..... B42D 15/022
USPC ..... 40/124.03
See application file for complete search history.

(56) References Cited

U.S. PATENT DOCUMENTS

| | | | | |
|---|---|---|---|---|
| 3,740,543 | A * | 6/1973 | Franc | 446/147 |
| 8,176,663 | B2 * | 5/2012 | Sapp et al. | 40/124.03 |
| 8,312,652 | B2 * | 11/2012 | Mayer et al. | 40/124.03 |
| 8,661,719 | B2 * | 3/2014 | Hughes et al. | 40/124.04 |
| 2007/0288057 | A1 * | 12/2007 | Kuhnel | 606/237 |
| 2010/0199530 | A1 * | 8/2010 | Sapp et al. | 40/124.03 |
| 2011/0078931 | A1 * | 4/2011 | Sapp et al. | 40/124.03 |
| 2012/0000101 | A1 * | 1/2012 | Jin et al. | 40/124.03 |

* cited by examiner

*Primary Examiner* — Gary Hoge
(74) *Attorney, Agent, or Firm* — Christine Flanagan

(57) ABSTRACT

The greeting card of the present invention contains a sound mechanism which is operative to replay one or more audio clips upon a user pulling a pull device which extends outward from the front of the greeting card. The pull device controls activation of the audio but also serves as a three-dimensional aspect of the scene or picture printed on the front of the greeting card.

20 Claims, 3 Drawing Sheets

GREETING CARD WITH PULL ACTIVATED EFFECTS

RELATED APPLICATIONS

This application claims priority to U.S. Provisional Patent Application No. 61/873,956, filed on Sep. 5, 2013, a copy of which is incorporated herein by reference in its entirety

FIELD OF THE INVENTION

The present invention is in the field of social expression products such as greeting cards.

SUMMARY OF THE INVENTION

The greeting card of the present invention contains a sound mechanism which is operative to replay one or more audio clips upon a user pulling a pull device which extends outward from the front of the greeting card. The pull device controls activation of the audio but also serves as a three-dimensional aspect of the scene or picture printed on the front of the greeting card.

DETAILED DESCRIPTION OF PREFERRED AND ALTERNATE EMBODIMENTS

Figure 2:
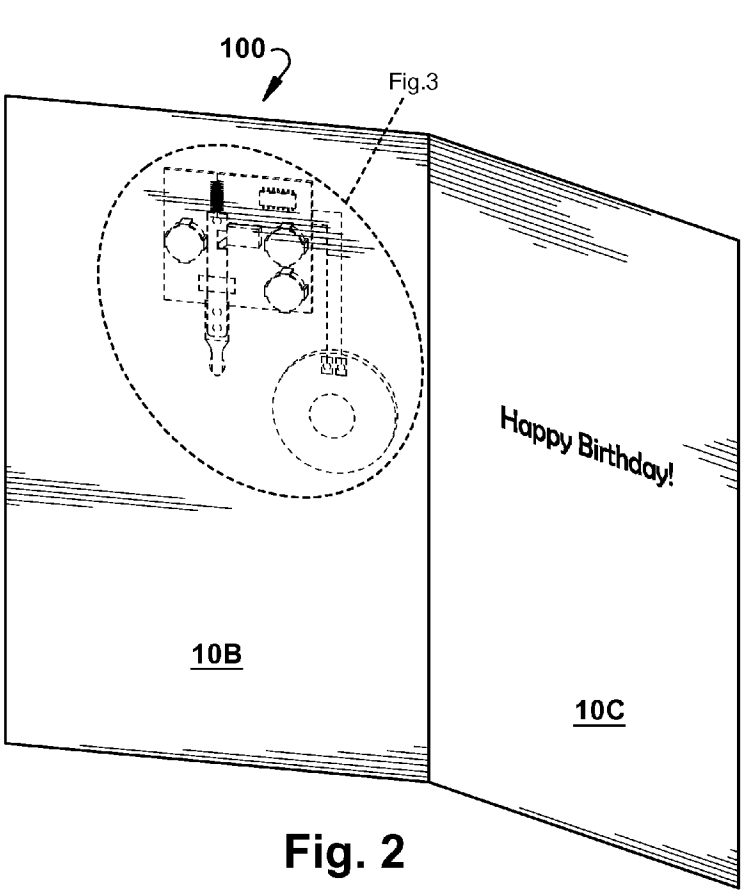
FIG. 2 is a perspective view of the greeting card of FIG. 1, in an opened position.

The present invention is directed to an interactive greeting card with pull activated effects, including audio, light, video, motor movement or motion or any other special effect. The greeting card includes a multi-panel greeting card body, various electronic components and one or more pull mechanisms which serves as both an activation mechanism and also forms a part of the greeting card artwork or visuals. In a preferred embodiment, the pull mechanism can be made of various materials including silicone, rubber, plastic, foam, gel, neoprene or other elastomeric materials having a spongy, stretchy, squishy, malleable or elastic feel. The material may alternatively be another type of material which is not typically associated with a greeting card, such as faux fur, hair-like material, wax, or other materials having a unique texture or touch sensation. The material of the pull mechanism is intended to add to the entertainment value and tactile user-experience when interacting with the greeting card.

The greeting card body 10 resembles a traditional greeting card, being made of paper, paperboard, cardboard, or other similar material. In one embodiment, the greeting card body 10 contains three greeting card panels. A first panel 10A is attached to a second panel 10B along a first fold line and the second panel 10B is attached to a third panel 10C along a second fold line. Each greeting card panel 10A, 10B, 10C contains a front surface and a rear surface. One or more of the greeting card panels may contain printing thereon, including but not limited to: artwork, photographs, drawings, text, or any other printable medium. The greeting card 100 is folded along either the first or second fold line to form a cavity between either the first 10A and second 10B panels or the second 10B and third 10C panels. The first greeting card panel 10A is folded backwards along the first fold line to lie below the second greeting card panel 10B. The front surface of the first greeting card panel 10A is attached adhesively or otherwise to the rear surface of the second greeting card panel 10B. The electronic components of the greeting card 100 are attached to the rear surface of the second greeting card panel 10B prior to the first greeting card panel 10A being attached thereto. The electronics are contained and concealed within the cavity formed between the first 10A and second 10B greeting card panels. The greeting card 100 is then folded forward along the second fold line to form a typical two panel greeting card which folds and unfolds about a single fold line. The front surface of the first panel 10A serves as the front panel of the greeting card 100 and the front surface of the second 10B and third 10C panels serve as the right and left inside panels of the greeting card 100, and the rear surface of the third panel 10C serves as the rear surface of the greeting card 100. In another embodiment, the greeting card may be a multi-panel greeting card construction having various panels which are connected along various fold lines. The greeting card may alternately contain various panels which contain one or more slots or openings thereon, into which another card or a removable panel may be inserted. Another version may contain a protective insert made of cardboard or foam which surrounds the electronic components of the greeting card and which is wrapped in or covered with one or more greeting card panels. The greeting card may alternatively be made of a foam body having a planar sheet material attached to the front and/or back surface thereof. The greeting card may also contain various greeting card panels attached along various fold lines and having one or more flaps or doors created therein which the user can open to reveal a message or other surprise thereunder. The structure of the greeting card can take on may shapes and configurations and is not intended to be limited in any way by this disclosure.

Figure 3:
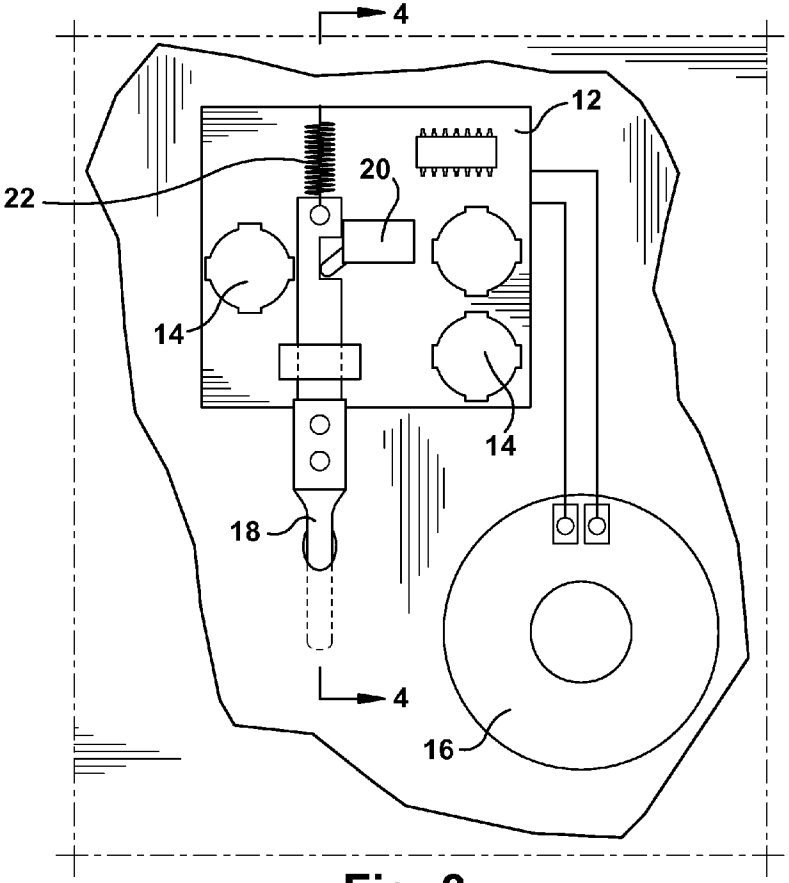
FIG. 3 is a front view of the electronic components of the greeting card of FIG. 1.
Figure 5:
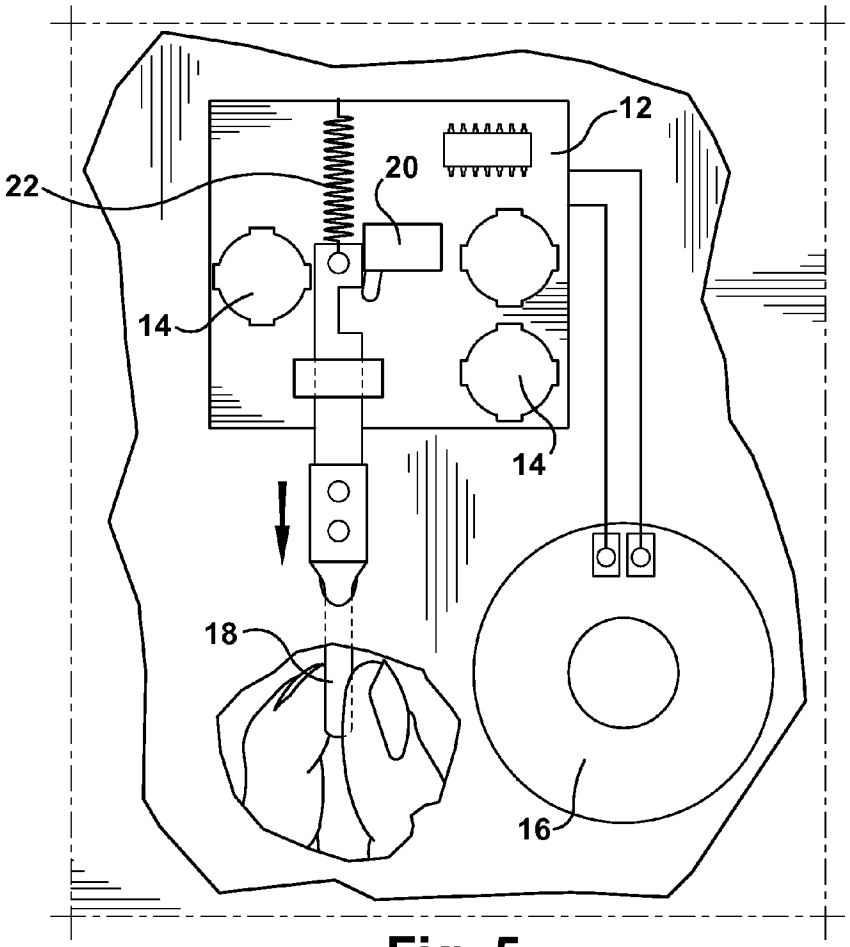
FIG. 5 is a front view of the electronic components of the greeting card of FIG. 1, with stretched pull device.

The electronic components of the greeting card, some of which are shown in FIGS. 2, 3 and 5, may include, but are not limited to: a printed circuit board 12, an integrated circuit, a power source such as one or more small cell disposable batteries 14, a memory device, at least one audio recording saved on the memory device, a speaker 16, one or more lights and/or fiber optic strands or bundles, one or more motor mechanisms, one or more switch mechanism, and any other component that is necessary to or which facilitates storing one or more audio files and replaying said audio files on command or which is necessary to or facilitates motor movement, the illumination or distinguishing of lights or fiber optics, or any other special effects. These types of electronic components are known to one with skill in the art and will not be discussed in detail herein. The electronic components are contained and concealed within the greeting card.

A pull mechanism (also referred to herein as a "pull device") is intended to be used as an effects activator and also as an entertaining element of the greeting card. As mentioned above, in a preferred embodiment, the pull mechanism is made of a silicone, rubber, plastic, foam, gel, neoprene or other elastomeric materials having a spongy, stretchy, squishy, malleable or elastic feel. The pull mechanism may also be made of other highly tactile materials such as faux fur or hair. In one embodiment, which is shown in the figures, a pull device 18 is attached at one end to a switch mechanism 20, making the pull device 18 partially contained within a cavity formed between two panels of the greeting card 100.

Figure 1:
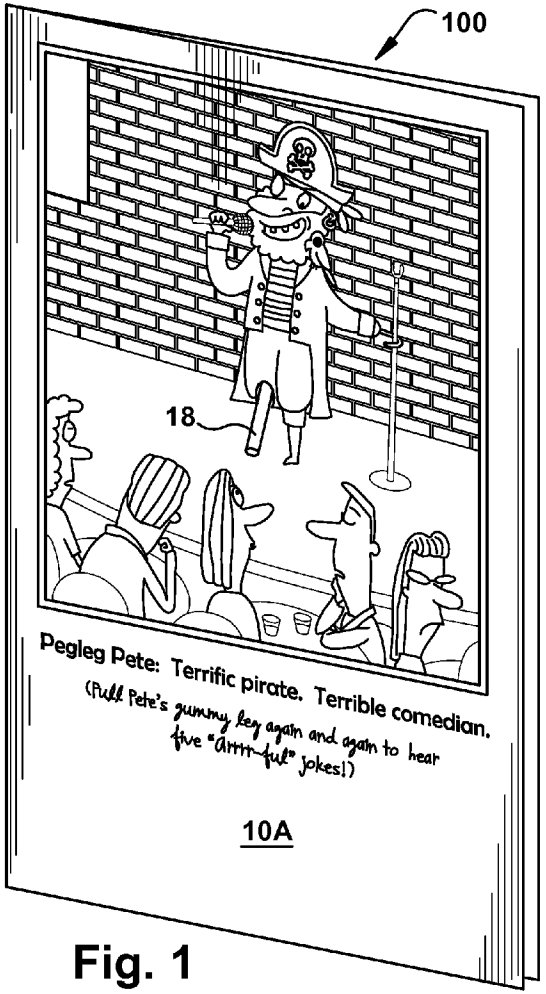
FIG. 1 is a perspective view of the greeting card of the present invention, in a closed position.
Figure 4:
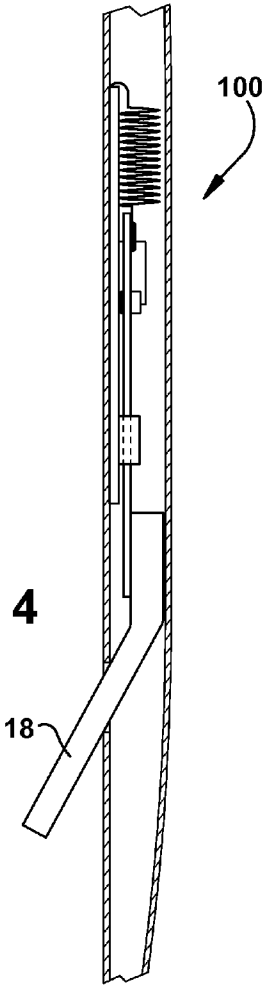
FIG. 4 is a side view of FIG. 3 from the perspective of arrows 4-4.

The opposite end of the pull device 18 exits the cavity through an opening in the front cover 10A of the greeting card 100 and protrudes therethrough, as shown in FIG. 1. The switch mechanism 20 is also attached to a spring mechanism 22 such that when a user pulls on the pull device 18, the spring 22 is stretched (FIG. 5) and the switch mechanism 20 is triggered to replay an audio file. When the user releases the pull device 20, the spring 22 retracts back to its original position (FIG. 3). In this embodiment, the pull device 18 is made of molded silicone and is formed in an elongate cylindrical shape, although it can be made of other materials and come in other shapes and sizes. The silicone (or other material) may be of any color and may take on any molded shape. It also has a squishy or spongy feel and it is elastic in that it snaps back to its original shape or length once it is pulled and then released. The feel and elasticity of the pull mechanism also adds to the entertainment value of the greeting card. Additionally, the pull device 18 not only triggers the pre-recorded audio but also serves as part of a picture or scene depicted on the front face 10A of the greeting card 100. For example, in the embodiment shown in FIG. 1, the picture or scene printed on the front of the greeting card 100 is of a peg-legged pirate. The silicone pull device 18 is inserted through an opening in the greeting card panel 10A in the area of the pirate's leg such that the silicone pull device 18 extends through the opening to represent the pirate's peg leg. The pull mechanism 18 can be positioned in different ways according to the scene printed on the greeting card 100. The user may have to pull the pull mechanism 18 to the right or to the left in a sideways manner, or the user may have to pull upwards, downwards or anywhere angled in between. The audio which is played upon a user pulling on the silicone pull device 18 may be recorded in a pirate-like voice to correspond to the theme of the greeting card 100. Each time the pull device 18 is pulled, a different vocal clip may be replayed. The vocal clips may be spoken word, songs, or any other recordable sound. In a preferred embodiment, five different vocal clips are played back in sequence and repeated. However, any number of clips may be stored and played back and the clips may be placed back in sequence or at random. In general, the voice on the sound clips will be of a character or animal which is part of the scene or printing on the greeting card, although any different type of voices can be used and are not required to contain the voice of a character or animal printed on the greeting card.

In an alternate embodiment, the greeting card of the present invention may contain more than one pull mechanism on the greeting card. The different pull mechanisms may control different audio clips or different special effects and they may represent different portions of the scene or printing on the greeting card. The pull mechanisms may also be of different colors and take on different shapes or sizes.

In other embodiments, similar to that shown in the figures, the greeting card may contain artwork and/or other embellishments depicting a person or specific character. The pull mechanism can be made, in different embodiments, to represent one or more body parts of the person or character depicted on the greeting card. Examples include, but are not limited to: one or both legs, such as the pirate character shown in FIGS. 1-5; one or both arms; two arms of a person or character which are pulled apart or in opposite directions or pulled forward (similar to a hug); a neck, a nose; one or both ears, one or both nipples; a tongue; and hair.

In another embodiment, the greeting card may contain artwork and/or other embellishments which depict an animal thereon. The pull mechanism may represent the animal itself or one or more body parts of an animal. Examples include, but are not limited to: a rabbit pulled from a hat; a rabbit or other critter pulled from a hole in the ground; the tongue of a dog or other animal; one or more ears of a dog or other animal; a tail of a dog or other animal; one or more udders of a pig, cow or horse; one or more quills of a porcupine, and one or more tentacles of an octopus. Another example is one or more monkeys hanging from a tree, wherein pulling on one of the monkeys activates audio or other special effect.

In still another embodiment, the greeting card may contain artwork and/or other embellishments which depict a type of food or drink thereon. The pull mechanism may represent a stirrer, umbrella or straw inserted into one or more of a variety of drinks such as cocktails (margaritas, Pina colada, bloody Mary, or martini), a milkshake, a lemonade or iced tea, etc. Other examples include, but are not limited to: a worm sticking out of an apple; a candle atop a cake or a cupcake; a candle atop a cake which pulls various tiers of the cake (hidden sliding panels) out; one or more chopsticks in a carton of Chinese food; one or more French fries; and a flag atop a hamburger bun which initiates movement of the hamburger or hamburger bun or opens a set of eyes placed thereon.

In yet another embodiment, the greeting card may contain a variety of different pictures and/or embellishments thereon. Examples of the pull mechanism include, but are not limited to: a stack of money or single bill coming out of an ATM machine, a brief case, a duffle bag, a wallet or a purse; a microphone which is set up in front of a character or in the middle of a boxing ring; a pull cord of a lamp or a toilet; a slingshot; the stems of a cactus; and the leaves of a tree. The greeting card may also contain a variety of different pull mechanisms which are placed behind one or more flaps or doors contained on or within the greeting card, or a single pull mechanism may be contained behind a series of flaps or doors which are placed in a stacked arrangement on the greeting card.

In another alternate embodiment of the present invention, the pull mechanism described herein may be used in combination with a gift bag. A traditional gift open-ended gift bag may contain one or more pull mechanisms thereon which trigger sound or other special effects. One or more panels of the gift bag may be double walled to neatly contain the electronic components and trigger switch therein. As described above with respect to the greeting card, the gift bag may have a scene or picture printed thereon and the pull mechanism may serve as part of that scene or picture, such as serving as a character's arm or leg, or an animal's nose, or any other the examples set forth above with respect to the greeting card embodiments. Pulling on the pull mechanism may initiate audio playback or may initiate some other type of special effect (explained below) or a combination thereof.

In other embodiments, the greeting card or gift bag described herein may, in addition to being audio capable, may also have lights, moving elements (via an electric motor), a release of confetti or any other special effect or combination thereof. The greeting card or gift bag may have a single pull mechanism which initiates one or more special effects or they may contain more than one pull mechanism which each initiate a different effect.

While particular components, materials, shapes and decor have been described herein to represent a preferred embodiment of the present invention, these examples are not meant to limit the invention in any way. Other variations of the described components of the invention have been contemplated and are considered to be within the scope of the present invention. The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. An interactive greeting card comprising:

a multi-panel greeting card body;

a sound module operative to store and replay at least one audio clip;

a pull mechanism which is an elongate, cylindrical shape made of rubber, silicone, neoprene or gel, which is partially contained within a cavity contained in the multi-panel greeting card body and partially contained outside of said cavity, the pull mechanism operative to initiate playback of the at least one audio clip upon pulling thereon;

wherein the pull mechanism completes part of a picture printed on the greeting card body, and wherein the pull mechanism extends outward at an angle from a front face of the multi-panel greeting card body.

2. The interactive greeting card of claim 1, wherein the pull mechanism is accessed through the front face of the greeting card.

3. The interactive greeting card of claim 1, wherein the at least one audio clip contains a message spoken in the voice of a character printed on the greeting card.

4. The interactive greeting card of claim 1, wherein the pull mechanism is also operative to activate one or more lights contained on the greeting card.

5. The interactive greeting card of claim 1, wherein the pull mechanism snaps back to its original position after being pulled.

6. The interactive greeting card of claim 1, wherein two different pull mechanisms are contained on the greeting card which are operative to playback different audio clips.

7. An interactive greeting card comprising:

a greeting card body having three or more panels;

a sound module operative to store and playback one or more audio files;

a pull mechanism that is attached to a switch which controls activation of the sound module, the pull mechanism being accessed through an opening in one of the three or more greeting card panels;

wherein the pull mechanism is non-planar and is made of a material which is different from the material of the greeting card body.

8. The interactive greeting card of claim 7, wherein the pull mechanism is made of molded silicone.

9. The interactive greeting card of claim 7, wherein the pull mechanism also serves as a portion of the artwork printed on one of the at least three greeting card panels.

10. The interactive greeting card of claim 7, wherein the pull mechanism is accessed through an opening on a front face of the greeting card body.

11. The interactive greeting card of claim 7, wherein the pull mechanism must be pulled in a sideways direction.

12. The interactive greeting card of claim 7, wherein the pull mechanism must be pulled in a downward direction.

13. The interactive greeting card of claim 7, wherein the one or more audio files serves as a body part of a character or animal printed on the greeting card.

14. The interactive greeting card of claim 7, wherein the pull mechanism serves as a body part of a character printed on the greeting card.

15. An interactive greeting card comprising:

a greeting card body;

a molded silicone, elastic, cylindrical pull mechanism which is connected to a switch, the switch contained and concealed between a cavity formed between at least two panels of the greeting card body, the pull mechanism partially contained within the cavity formed between the at least two panels of the greeting card body;

wherein the pull mechanism exists the cavity at an angle through an opening in one of the at least two panels of the greeting card body; and wherein the switch activates one or more of the following effects: audio playback; illumination of one or more lights on the greeting card; activation of a motor module which causes movement of a mobile object attached to the greeting card.

16. The interactive greeting card of claim 15, wherein the pull mechanism is made from a material which is different from the greeting card body.

17. The interactive greeting card of claim 15, wherein the pull mechanism is elastic.

18. The interactive greeting card of claim 15, wherein the pull mechanism can be accessed through the front face of the greeting card.

19. The interactive greeting card of claim 15, wherein the at least one audio clip contains the voice of a character which is printed on the greeting card.

20. The interactive greeting card of claim 15, wherein the sound module contains a plurality of different audio clips which are played back in turn upon a user pulling on the pull mechanism.

* * * * *